US007351450B2

(12) United States Patent
Fuller et al.

(10) Patent No.: US 7,351,450 B2
(45) **Date of Patent: *Apr. 1, 2008**

(54) CORRECTING DEFECTIVE KINETICALLY SPRAYED SURFACES

(75) Inventors: Brian K Fuller, Rochester Hills, MI (US); Alaa A. Elmoursi, Troy, MI (US); Kenneth M Rahmoeller, West Bloomfield, MI (US)

(73) Assignee: Delphi Technologies, Inc., Troy, MI (US)

( * ) Notice: Subject to any disclaimer, the term of this patent is extended or adjusted under 35 U.S.C. 154(b) by 87 days.

This patent is subject to a terminal disclaimer.

(21) Appl. No.: 10/677,869

(22) Filed: Oct. 2, 2003

(65) Prior Publication Data

US 2005/0074560 A1 Apr. 7, 2005

(51) Int. Cl.
*C23C 4/12* (2006.01)
*B05D 1/12* (2006.01)

(52) U.S. Cl. ..... 427/456; 427/446; 427/448; 427/455; 427/142; 427/140; 427/180; 427/203; 427/205; 427/422

(58) Field of Classification Search ..... 427/455, 427/456, 446, 422, 140, 142, 448
See application file for complete search history.

(56) References Cited

U.S. PATENT DOCUMENTS

| | | | |
|---|---|---|---|
| 2,861,900 | A | 11/1958 | Smith et al. |
| 3,100,724 | A | 8/1963 | Rocheville |
| 3,876,456 | A | 4/1975 | Ford et al. |
| 3,993,411 | A | 11/1976 | Babcock et al. |
| 3,996,398 | A | 12/1976 | Manfredi |
| 4,263,335 | A | 4/1981 | Wagner et al. |
| 4,416,421 | A | 11/1983 | Browning et al. |
| 4,606,495 | A | 8/1986 | Stewart, Jr. et al. |
| 4,891,275 | A | 1/1990 | Knoll |
| 4,939,022 | A | 7/1990 | Palanisamy |
| 5,187,021 | A | 2/1993 | Vydra et al. |
| 5,217,746 | A | 6/1993 | Lenling et al. |
| 5,271,965 | A | 12/1993 | Browning |
| 5,302,414 | A | 4/1994 | Alknimor et al. |
| 5,308,463 | A | 5/1994 | Hoffmann et al. |
| 5,328,751 | A | 7/1994 | Komorita et al. |
| 5,330,798 | A * | 7/1994 | Browning ..... 427/446 |

(Continued)

FOREIGN PATENT DOCUMENTS

| | | |
|---|---|---|
| DE | 42 36 911 | 12/1993 |
| DE | 199 59 515 | 6/2001 |
| DE | 100 37 212 | 1/2002 |

(Continued)

OTHER PUBLICATIONS

Van Steenkiste, et al "Aluminum coatings via kinetic spray with relatively large powder particles", Surface and Coatings Technology 154 (2000) pp. 237-252.*

(Continued)

*Primary Examiner*—Katherine Bareford
(74) *Attorney, Agent, or Firm*—Scott A. McBain

(57) ABSTRACT

Disclosed is a method for repairing defects in kinetically sprayed surfaces. The typical defects comprise isolated or connected conical shaped holes in the kinetic spray coating. The repair involves thermally spraying a molten material into the defective area to fill in the cone followed by continued kinetic spraying to complete the coating.

13 Claims, 6 Drawing Sheets

U.S. PATENT DOCUMENTS 5,340,015 A 8/1994 Hira et al.
5,362,523 A 11/1994 Gorynin et al.
5,395,679 A 3/1995 Myers et al.
5,424,101 A 6/1995 Atkins et al.
5,464,146 A 11/1995 Zalvzec et al.
5,465,627 A 11/1995 Garshelis
5,476,725 A 12/1995 Papich et al.
5,493,921 A 2/1996 Alasafi
5,520,059 A 5/1996 Garshelis
5,525,570 A 6/1996 Chakraborty et al.
5,527,627 A 6/1996 Lautzenhiser et al.
5,585,574 A 12/1996 Sugihara et al.
5,593,740 A 1/1997 Strumbon et al.
5,648,123 A 7/1997 Kuhn et al.
5,683,615 A 11/1997 Munoz
5,706,572 A 1/1998 Garshelis
5,708,216 A 1/1998 Garshelis
5,725,023 A 3/1998 Padula
5,795,626 A 8/1998 Grabel et al.
5,854,966 A 12/1998 Kampe et al.
5,875,830 A 3/1999 Singer et al.
5,887,335 A 3/1999 Garshelis
5,889,215 A 3/1999 Kilmartin et al.
5,894,054 A 4/1999 Paruchuri et al.
5,907,105 A 5/1999 Pinkerton
5,907,761 A 5/1999 Tohma et al.
5,952,056 A 9/1999 Jordan et al.
5,965,193 A 10/1999 Ning et al.
5,989,310 A 11/1999 Chu et al.
5,993,565 A 11/1999 Pinkerton
6,033,622 A 3/2000 Maruyama
6,047,605 A 4/2000 Garshelis
6,051,045 A 4/2000 Narula et al.
6,051,277 A 4/2000 Claussen et al.
6,074,737 A 6/2000 Jordan et al.
6,098,741 A 8/2000 Gluf
6,119,667 A 9/2000 Boyer et al.
6,129,948 A 10/2000 Plummet et al.
6,139,913 A * 10/2000 Van Steenkiste et al. ... 427/191
6,145,387 A 11/2000 Garshelis
6,149,736 A 11/2000 Sugihara
6,159,430 A 12/2000 Foster
6,189,663 B1 2/2001 Smith et al.
6,260,423 B1 7/2001 Garshelis
6,261,703 B1 7/2001 Sasaki et al.
6,283,386 B1 9/2001 Van Steenkiste et al.
6,283,859 B1 9/2001 Carlson et al.
6,289,748 B1 9/2001 Lin et al.
6,338,827 B1 1/2002 Nelson et al.
6,344,237 B1 2/2002 Kilmer et al.
6,374,664 B1 4/2002 Bauer
6,402,050 B1 6/2002 Kashirin et al.
6,422,360 B1 7/2002 Oliver et al.
6,424,896 B1 7/2002 Lin
6,442,039 B1 8/2002 Schreiber
6,446,857 B1 9/2002 Kent et al.
6,465,039 B1 10/2002 Pinkerton et al.
6,485,852 B1 11/2002 Miller et al.
6,488,115 B1 12/2002 Ozsoylu
6,490,934 B2 12/2002 Garshelis
6,511,135 B2 1/2003 Ballinger et al.
6,537,507 B2 3/2003 Nelson et al.
6,551,734 B1 4/2003 Simpkins et al.
6,553,847 B2 4/2003 Garshelis
6,615,488 B2 9/2003 Anders
6,623,704 B1 9/2003 Roth
6,623,796 B1 9/2003 VanSteenkiste et al.
6,743,468 B2 * 6/2004 Fuller et al. ..... 427/191
2002/0071906 A1 6/2002 Rusch
2002/0073982 A1 6/2002 Shaikh et al.
2002/0102360 A1 8/2002 Subramanian et al.
2002/0110682 A1 * 8/2002 Brogan ..... 428/325
2002/0112549 A1 8/2002 Cheshmehdoost et al.
2002/0182311 A1 12/2002 Leonardi et al.
2003/0039856 A1 2/2003 Gillispie et al.
2003/0190414 A1 10/2003 VanSteenkiste
2003/0219542 A1 11/2003 Ewasyshyn et al.
2004/0065432 A1 * 4/2004 Smith et al. ..... 165/80.2

FOREIGN PATENT DOCUMENTS

DE 101 26 100 12/2002
EP 1 160 348 12/2001
EP 1245854 A2 2/2002
JP 55031161 3/1980
JP 61249541 11/1986
JP 04180770 6/1992
JP 04243524 8/1992
WO 98/22639 5/1998
WO 02/52064 1/2002
WO 03009934 2/2003

OTHER PUBLICATIONS

European Search Report dated Jan. 29, 2004 and it's Annex.
Dykhuizen, et al.; *Gas Dynamic Principles of Cold Spray;* Journal of Thermal Spray Technology; Jun. 1998; pp. 205-212.
McCune, et al; *An Exploration of the Cold Gas-Dynamic Spray Method for Several Materials Systems*, no date.
Ibrahim, et al; *Particulate Reinforced Metal Matrix Composites—A Review: Journal of Materials Science 26;* pp. 1137-1156, no date.
I.J. Garshelis, et al; *A Magnetoelastic Torque Transducer Utilizing a Ring Divided into Two Oppositely Polarized Circumferential Regions;* MMM 1995; Paper No. BB-08.
I.J. Garshelis, et al; *Development of a Non-Contact Torque Transducer for Electric Power Steering Systems;* SAE Paper No. 920707; 1992; pp. 173-182.
Boley, et al; *The Effects of Heat Treatment on the Magnetic Behavior of Ring—Type Magnetoelastic Torque Sensors;* Proceedings of Sicon '01; Nov. 2001.
J.E. Snyder, et al; *Low Coercivity Magnetostrictive Material with Giant Piezomagnetic d33,* Abstract Submitted for the MAR99 Meeting of the American Physical Society, no date.
Pavel Ripka, et al; *Pulse Excitation of Micro-Fluxgate Sensors,* IEEE Transactions on Magnetics, vol. 37, No. 4, Jul. 2001, pp. 1998-2000.
Trifon M. Liakopoulos, et al; *Ultrahigh Resolution DC Magnetic Field Measurements Using Microfabricated Fluxgate Sensor Chips*, University of Cincinnati, Ohio, Center for Microelectronic Sensors and MEMS, Dept. of ECECS pp. 630-631, no date.
Derac Son, *A New Type of Fluxgate Magnetometer Using Apparent Coercive Field Strength Measurement*, IEEE Transactions on Magnetics, vol. 25, No. 5, Sep. 1989, pp. 3420-3422.
O. Dezauri, et al; *Printed Circuit Board Integrated Fluxgate Sensor*, Elsevier Science S. A. (2000) Sensors and Actuators, pp. 200-203.
How, et al; *Generation of High-Order Harmonics in Insulator Magnetic Fluxgate Sensor Cores*, IEEE Transactions on Magnetics, vol. 37, No. 4, Jul. 2001, pp. 2448-2450.
Moreland, *Fluxgate Magnetometer*, Carl W. Moreland, 199-2000, pp. 1-9.
Ripka, et al; *Symmetrical Core Improves Micro-Fluxgate Sensors*, Sensors and Acutuators, Version 1, Aug. 25, 2000, pp. 1-9.
Hoton How, et al; *Development of High-Sensitivity Fluxgate Magnetometer Using Single-Crystal Yttrium Iron Garnet Thick Film as the Core Material, ElectroMagnnetic Applications, Inc*, no date.
Ripka, et al; *Microfluxgate Sensor with Closed Core*, submitted for Sensors and Actuators, Version 1, Jun. 17, 2000.
Henriksen, et al; *Digital Detection and Feedback Fluxgate Magnetometer*, Meas. Sci. Technol. 7 (1996) pp. 897-903.
Cetek 930580 Compass Sensor, *Specifications*, Jun. 1997.
Geyger, *Basic Principles Characteristics and Applications*, Magnetic Amplifier Circuits, 1954, pp. 219-232.
Van Steenkiste, et al; *Kinetic Spray Coatings*; in Surface & Coatings Technology III; 1999; pp. 62-71.

Liu, et al; *Recent Development in the Fabrication of Metal Matrix-Particulate Composites Using Powder Metallurgy Techniques*; in Journal of Material Science 29; 1994; pp. 1999-2007; National University of Singapore, Japan.

Papyrin; *The Cold Gas-Dynamic Spraying Method a New Method for Coatings Deposition Promises a New Generation of Technologies; Novosibirsk, Russia*, no date.

McCune, al; Characterization of Copper and Steel Coatings Made by the Cold Gas-Dynamic Spray Method; National Thermal Spray Conference, no date.

Alkhimov, et al; *A Method of "Cold" Gas-Dynamic Deposition; Sov. Phys. Kokl. 36*(Dec. 12, 1990; pp. 1047-1049.

Dykuizen, et al; *Impact of High Velocity Cold Spray Particles*; in Journal of Thermal Spray Technology 8(4); 1999; pp. 559-564.

Swartz, et al; Thermal Resistance At Interfaces; *Appl. Phys. Lett*., vol. 51, No. 26,28; Dec. 1987; pp. 2201-2202.

Davis, et al; Thermal Conductivity of Metal-Matrix Composlites; *J.Appl. Phys. 77* (10), May 15, 1995; pp. 4494-4960.

Stoner et al; *Measurements of the Kapitza Conductance between Diamond and Several Metals*; Physical Review Letters, vol. 68, No. 10; Mar. 9, 1992; pp. 1563-1566.

Stoner et al; *Kapitza conductance and heat flow between solids at temperatures from 50 to 300K*; Physical Review B, vol. 48, No. 22, Dec. 1, 1993-II; pp. 16374;16387.

Johnson et al; *Diamond/Al metal matrix composites formed by the pressureless metal infiltration process*; J. Mater, Res., vol. 8, No. 5, May 1993; pp. 11691173.

Rajan et al; *Reinforcement coatings and interfaces in Aluminium Metal Matrix Composites*; pp. 3491-3503.

*LEC Manufacturing and Engineering Capabilities*; Lanxide Electronic Components, Inc.

Dykhuizen et al; *Gas Dynamic Principles of Cold Spray*; Journal of Thermal Spray Technology; Jun. 1998; pp. 205-212.

McCune et al; *An Exploration of the Cold Gas-Dynamic Spray Method For Several Materials Systems*.

Ibrahim et al; Particulate Reinforced Metal Matrix Composites—A Review; *Journal of Materials Science 26*; pp. 1137-1156.

* cited by examiner

CORRECTING DEFECTIVE KINETICALLY SPRAYED SURFACES

TECHNICAL FIELD

The present invention is related to a kinetic spray process and, more particularly, to a method for healing defective kinetically sprayed surfaces.

INCORPORATION BY REFERENCE

U.S. Pat. No. 6,139,913, "Kinetic Spray Coating Method and Apparatus," and U.S. Pat. No. 6,283,386 "Kinetic Spray Coating Apparatus" are incorporated by reference herein.

BACKGROUND OF THE INVENTION

A new technique for producing coatings on a wide variety of substrate surfaces by kinetic spray, or cold gas dynamic spray, was recently reported in articles by T. H. Van Steenkiste et al., entitled "Kinetic Spray Coatings," published in Surface and Coatings Technology, vol. 111, pages 62-71, Jan. 10, 1999 and "Aluminum coatings via kinetic spray with relatively large powder particles" published in Surface and Coatings Technology 154, pages 237-252, 2002. The articles discuss producing continuous layer coatings having low porosity, high adhesion, low oxide content and low thermal stress. The articles describe coatings being produced by entraining metal powders in an accelerated air stream, through a converging-diverging de Laval type nozzle and projecting them against a target substrate. The particles are accelerated in the high velocity air stream by the drag effect. The air used can be any of a variety of gases including air or helium. It was found that the particles that formed the coating did not melt or thermally soften prior to impingement onto the substrate. It is theorized that the particles adhere to the substrate when their kinetic energy is converted to a sufficient level of thermal and mechanical deformation. Thus, it is believed that the particle velocity must be high enough to exceed the yield stress of the particle to permit it to adhere when it strikes the substrate. It was found that the deposition efficiency of a given particle mixture was increased as the inlet air temperature was increased. Increasing the inlet air temperature decreases its density and increases its velocity. The velocity of the main gas varies approximately as the square root of the inlet air temperature. The actual mechanism of bonding of the particles to the substrate surface is not fully known at this time. It is believed that the particles must exceed a critical velocity prior to their being able to bond to the substrate. The critical velocity is dependent on the material of the particle and to a lesser degree on the material of the substrate. It is believed that the initial particles to adhere to a substrate have broken the oxide shell on the substrate material permitting subsequent metal to metal bond formation between plastically deformed particles and the substrate. Once an initial layer of particles has been formed on a substrate subsequent particles not only fill the voids between previous particles bound to the substrate but also engage in particle to particle bonds. The particles also break any oxide shells on previously bonded particles. The bonding process is not due to melting of the particles in the air stream because while the temperature of the air stream may be above the melting point of the particles, due to the short exposure time the particles are never heated to a temperature above their melt temperature. This feature is considered critical because the kinetic spray process allows one to deposit particles onto a surface without a phase transition.

This work improved upon earlier work by Alkimov et al. as disclosed in U.S. Pat. No. 5,302,414, issued Apr. 12, 1994. Alkimov et al. disclosed producing dense continuous layer coatings with powder particles having a particle size of from 1 to 50 microns using a supersonic spray.

The Van Steenkiste articles reported on work conducted by the National Center for Manufacturing Sciences (NCMS) and by the Delphi Research Labs to improve on the earlier Alkimov process and apparatus. Van Steenkiste et al. demonstrated that Alkimov's apparatus and process could be modified to produce kinetic spray coatings using particle sizes of greater than 50 microns.

The modified process and apparatus for producing such larger particle size kinetic spray continuous layer coatings are disclosed in U.S. Pat. Nos. 6,139,913, and 6,283,386. The process and apparatus described provide for heating a high pressure air flow and combining this with a flow of particles. The heated air and particles are directed through a de Laval-type nozzle to produce a particle exit velocity of between about 300 m/s (meters per second) to about 1000 m/s. The thus accelerated particles are directed toward and impact upon a target substrate with sufficient kinetic energy to bond the particles to the surface of the substrate. The temperatures and pressures used are sufficiently lower than that necessary to cause particle melting or thermal softening of the selected particle. Therefore, as discussed above, no phase transition occurs in the particles prior to bonding. It has been found that each type of particle material has a threshold critical velocity that must be exceeded before the material begins to adhere to the substrate by the kinetic spray process.

The kinetic spray process has been used to create very thick layers of several centimeters in thickness or more. In addition, the process has been used to create tooling because of its versatility and ability to rapidly build thick layers. One difficulty that can occur in layers of any thickness, but that can be quite noticeable in layers that are 5 millimeters or thicker, is the formation of defects. These defects typically have the shape of right conical cones. Once they begin to develop they are stable and can not be corrected by the kinetic spray process. Continued kinetic spraying leads to an enlarging of the defect. The defects are normal to the surface being sprayed and they have a near constant slant height S described by the equation:

$$S=(R^2+H^2)^{0.5}$$

Wherein R is the radius of the cone defect and H is the height of the cone. In the past, these defects required discarding of the kinetically sprayed surface because they could not be repaired. This leads to costly operations and time delays, particularly if the defect is not observed immediately. It would be advantageous to develop a method for repairing these defective surfaces that once applied would allow for continued kinetic spraying of the repaired surface.

SUMMARY OF THE INVENTION

In one embodiment, the present invention is a method for repairing a defect in a kinetically sprayed surface comprising the steps of providing a kinetically sprayed surface having a defect in the surface, applying a repair coating to the defect by thermally spraying a molten material on the defect, thereby filling the defect and repairing the defect.

BRIEF DESCRIPTION OF THE DRAWINGS

The present invention will now be described, by way of example, with reference to the accompanying drawings, in which.

DESCRIPTION OF THE PREFERRED EMBODIMENT

The present invention comprises a method for repairing a defective kinetically sprayed surface. The method combines the use of a thermal spray process, which is known in the art, with the relatively new technology of the kinetic spray process. The kinetic spray process used is generally described in U.S. Pat. Nos. 6,139,913, 6,283,386 and the two articles by Van Steenkiste, et al. entitled "Kinetic Spray Coatings", published in Surface and Coatings Technology, Volume III, pages 62-72, Jan. 10, 1999 and "Aluminum coatings via kinetic spray with relatively large powder particles", published in Surface and Coatings Technology 154, pages 237-252, 2002, all of which are herein incorporated by reference.

Figure 1:
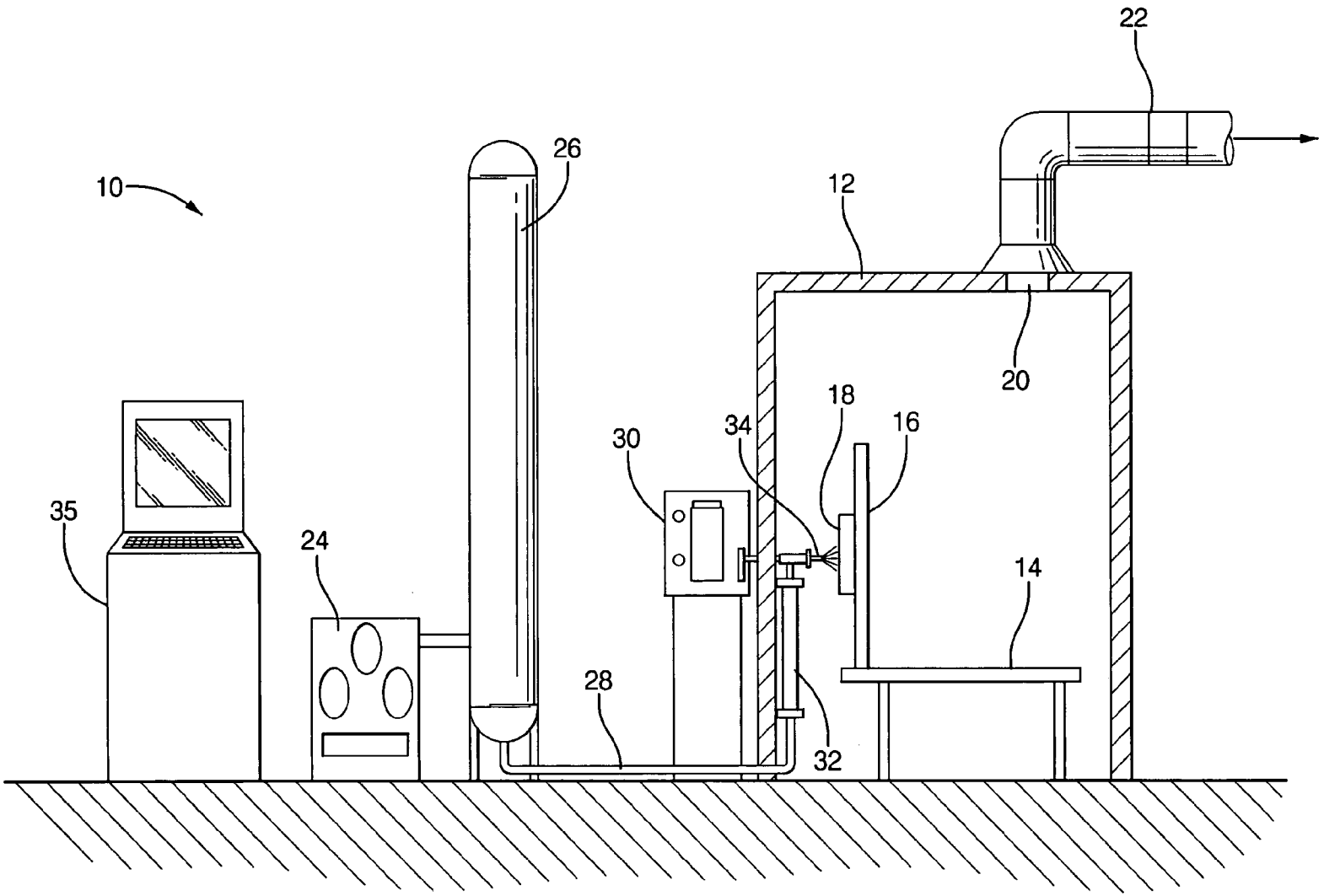
FIG. 1 is a schematic layout illustrating a kinetic spray system for performing the method of the present invention.

Referring first to FIG. 1, a kinetic spray system for use according to the present invention is generally shown at 10. System 10 includes an enclosure 12 in which a support table 14 or other support means is located. A mounting panel 16 fixed to the table 14 supports a work holder 18 capable of movement in three dimensions and able to support a suitable substrate material to be coated. The enclosure 12 includes surrounding walls having at least one air inlet, not shown, and an air outlet 20 connected by a suitable exhaust conduit 22 to a dust collector, not shown. During coating operations, the dust collector continually draws air from the enclosure 12 and collects any dust or particles contained in the exhaust air for subsequent disposal.

The spray system 10 further includes an air compressor 24 capable of supplying air pressure up to 3.4 MPa (500 psi) to a high pressure air ballast tank 26. The air ballast tank 26 is connected through a line 28 to both a high pressure powder feeder 30 and a separate air heater 32. The air heater 32 supplies high pressure heated air, the main gas described below, to a kinetic spray nozzle 34. The temperature of the main gas varies from 100 to 3000° C., depending on the powder or powders being sprayed. The pressure of the main gas and the powder feeder varies from 200 to 500 psi. The powder feeder 30 mixes particles of a powder or a powder mixture of particles with unheated high-pressure air and supplies the mixture to a supplemental inlet line 48 of the nozzle 34. The particles are described below and may comprise a metal, an alloy, a ceramic, or mixtures thereof. As known to those of ordinary skill in the art an alloy is defined as a solid or liquid mixture of two or more metals, or of one or more metals with certain nonmetallic elements, as in carbon containing steel. A computer control 35 operates to control both the pressure of air supplied to the air heater 32 and the temperature of the heated main gas exiting the air heater 32. As would be understood by one of ordinary skill in the art, the system 10 can include multiple powder feeders 30, all of which are connected to supplemental feedline 48. For clarity only one powder feeder 30 is shown in FIG. 1. Having multiple powder feeders 30 allows one to spray mixtures, or to rapidly switch between spraying one particle population to spraying a multiple of particle populations. Thus, an operator can form zones of two or more types of particles that smoothly transition to a single particle type and back again.

Figure 2:
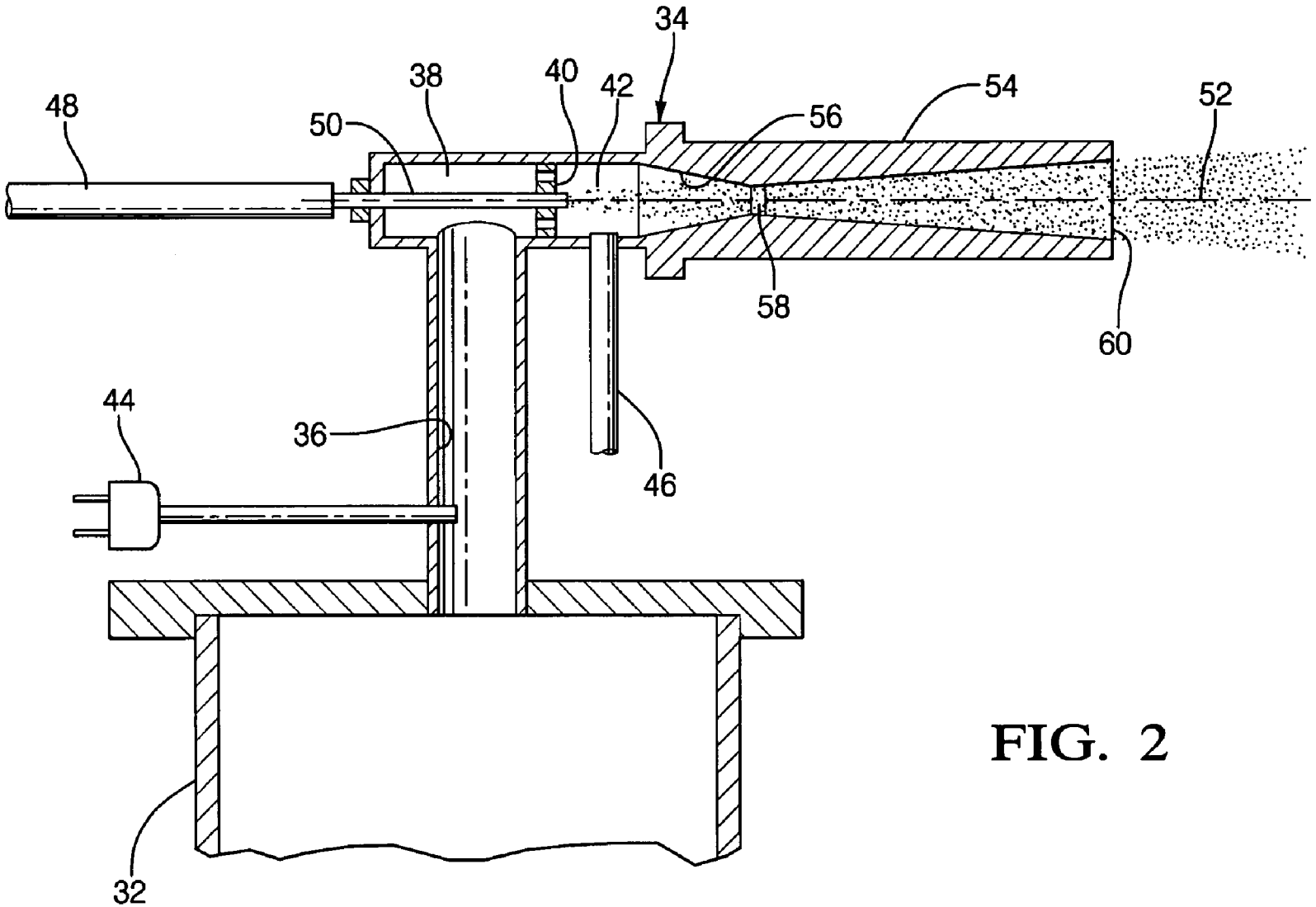
FIG. 2 is an enlarged cross-sectional view of a kinetic spray nozzle used in the system.

FIG. 2 is a cross-sectional view of the nozzle 34 and its connections to the air heater 32 and the supplemental inlet line 48. A main air passage 36 connects the air heater 32 to the nozzle 34. Passage 36 connects with a premix chamber 38 which directs air through a flow straightener 40 and into a mixing chamber 42. Temperature and pressure of the air or other heated main gas are monitored by a gas inlet temperature thermocouple 44 in the passage 36 and a pressure sensor 46 connected to the mixing chamber 42.

The mixture of unheated high pressure air and coating powder is fed through the supplemental inlet line 48 to a powder injector tube 50 comprising a straight pipe having a predetermined inner diameter. The predetermined diameter can range from 0.40 to 3.00 millimeters. Preferably it ranges from 0.40 to 0.90 millimeters in diameter. The tube 50 has a central axis 52 which is preferentially the same as the axis of the premix chamber 38. The tube 50 extends through the premix chamber 38 and the flow straightener 40 into the mixing chamber 42.

Mixing chamber 42 is in communication with the de Laval type nozzle 54. The nozzle 54 has an entrance cone 56 that decreases in diameter to a throat 58. Downstream of the throat is an exit end 60. The largest diameter of the entrance cone 56 may range from 10 to 6 millimeters, with 7.5 millimeters being preferred. The entrance cone 56 narrows to the throat 58. The throat 58 may have a diameter of from 3.5 to 1.5 millimeters, with from 3 to 2 millimeters being preferred. The portion of the nozzle 54 from downstream of the throat 58 to the exit end 60 may have a variety of shapes, but in a preferred embodiment it has a rectangular cross-sectional shape. At the exit end 60 the nozzle 54 preferably has a rectangular shape with a long dimension of from 8 to 14 millimeters by a short dimension of from 2 to 6 millimeters. The distance from the throat 58 to the exit end 60 may vary from 60 to 400 millimeters.

As disclosed in U.S. Pat. Nos. 6,139,913 and 6,283,386 the powder injector tube 50 supplies a particle powder mixture to the system 10 under a pressure in excess of the pressure of the heated main gas from the passage 36. The nozzle 54 produces an exit velocity of the entrained particles of from 300 meters per second to as high as 1200 meters per second. The entrained particles gain kinetic and thermal energy during their flow through this nozzle. It will be recognized by those of skill in the art that the temperature of the particles in the gas stream will vary depending on the particle size and the main gas temperature. The main gas temperature is defined as the temperature of heated high-pressure gas at the inlet to the nozzle 54. These temperatures and the exposure time of the particles are kept low enough that the particles are always at a temperature below their melting temperature so even upon impact, there is no change in the solid phase of the original particles due to transfer of kinetic and thermal energy, and therefore no change in their original physical properties. The particles exiting the nozzle 54 are directed toward a surface of a substrate to coat it.

Upon striking a substrate opposite the nozzle 54 the particles flatten into a nub-like structure with an aspect ratio of generally about 5 to 1. When the substrate is a metal and the particles include a metal, all the particles striking the substrate surface fracture the oxidized surface layer and the metal particles subsequently form a direct metal-to-metal bond between the metal particle and the metal substrate. Upon impact the kinetic sprayed particles transfer substantially all of their kinetic and thermal energy to the substrate surface and stick if their yield stress has been exceeded. As discussed above, for a given particle to adhere to a substrate it is necessary that it reach or exceed its critical velocity which is defined as the velocity where at it will adhere to a substrate when it strikes the substrate after exiting the nozzle 54. This critical velocity is dependent on the material composition of the particle. In general, harder materials must achieve a higher critical velocity before they adhere to a given substrate. It is not known at this time exactly what is the nature of the particle to substrate bond; however, it is believed that a portion of the bond is due to the particles plastically deforming upon striking the substrate.

EXAMPLES

FIGS. 3-6 show copper coatings on copper substrates wherein the coatings are applied by a kinetic spray process and there are defects in the coating. In all the examples the copper particles were applied using a kinetic spray process with the following parameters: particle sizes were from 50 micron to less than 106 micron, main gas pressure 300 pounds per square inch, powder feed pressure 350 pounds per square inch, main gas temperature 900° F., traverse rate 0.25 inches per second, and standoff distance of approximately 1 inch.

Figure 6:
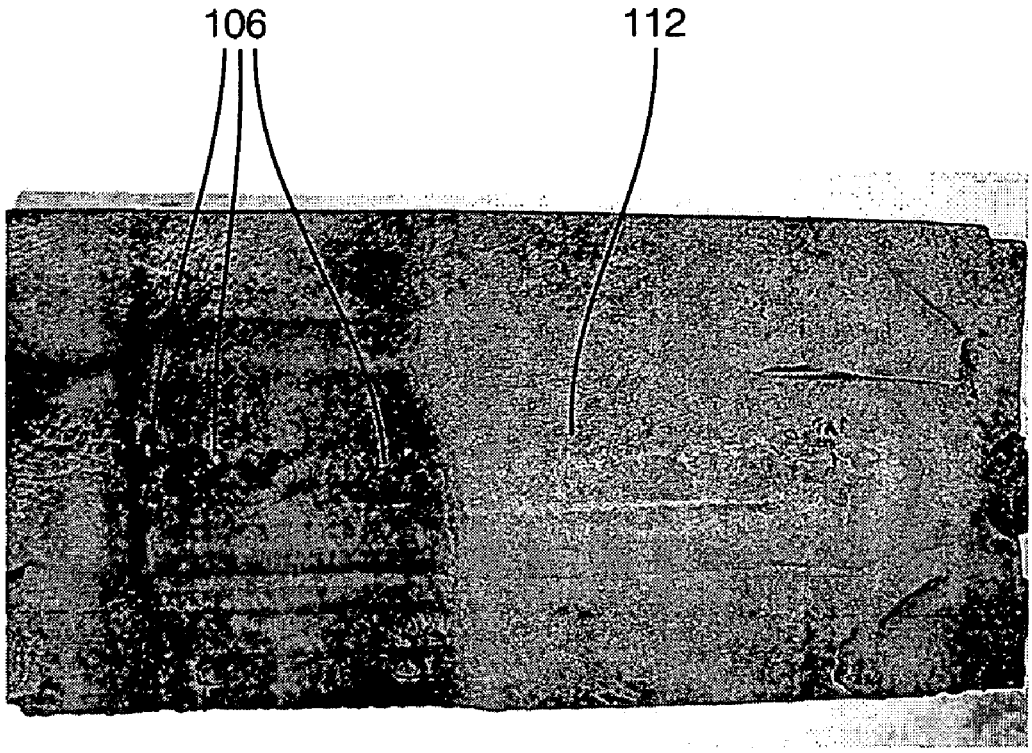
FIG. 6 is a photograph of the defects shown in FIG. 4 after repair of a portion according to the present invention.

In FIG. 6 half of the defective surface has been repaired using a thermal spray process according to the present invention. Specifically, the thermal spray was applied using a wire arc thermal spray process with the following parameters: arc gun TAFA 8835, wires Tafa Monel wire type 70T a nickel/copper alloy, 31 volts and 200 amps for the arc, air pressure of 130 pounds per square inch for atomization and 90 pounds per square inch for cooling, traverse speed of 100 millimeters per second, and a standoff distance of 9 inches.

Figure 3:
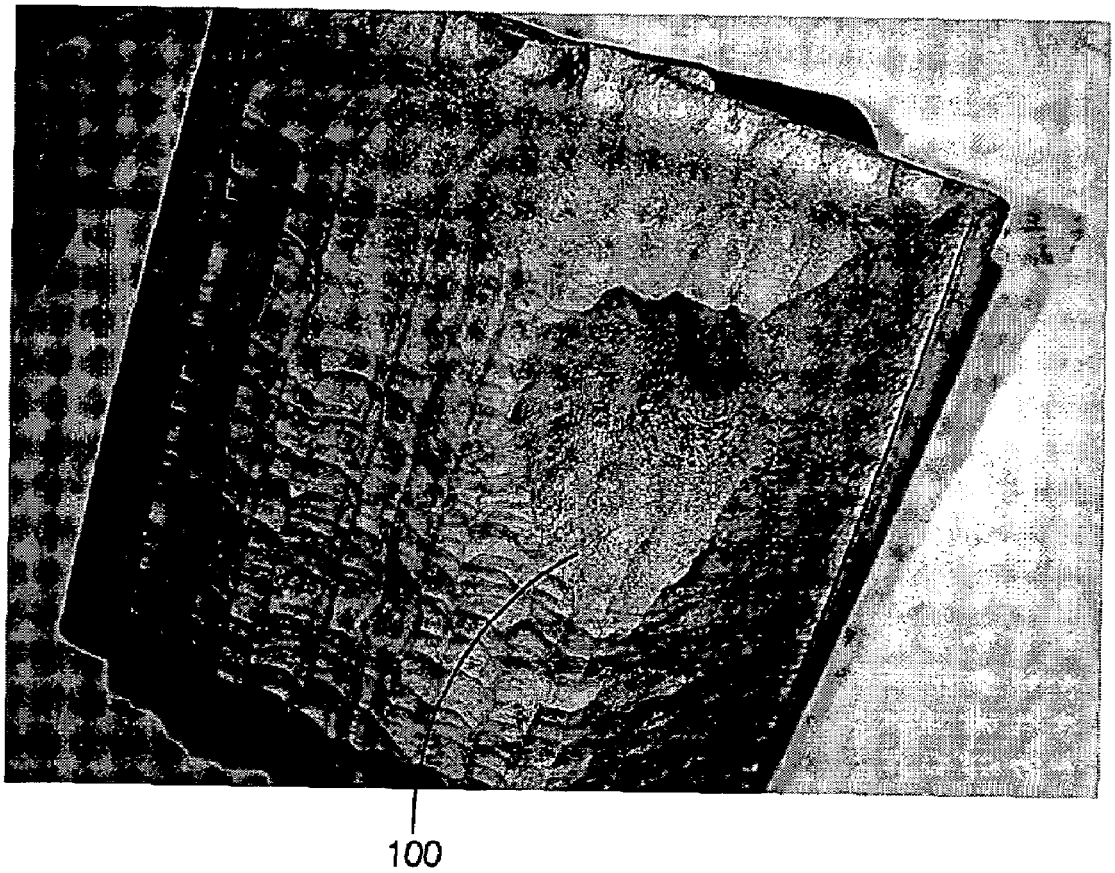
FIG. 3 is photograph of a kinetically sprayed surface showing a large conical defect.

In FIG. 3 an example of a kinetically sprayed copper surface exhibiting a large conical defect is shown at 100. The cone is 1.3 inches high and at a height of 0.95 inches the diameter of the defect is about 0.95 inches.

Figure 4:
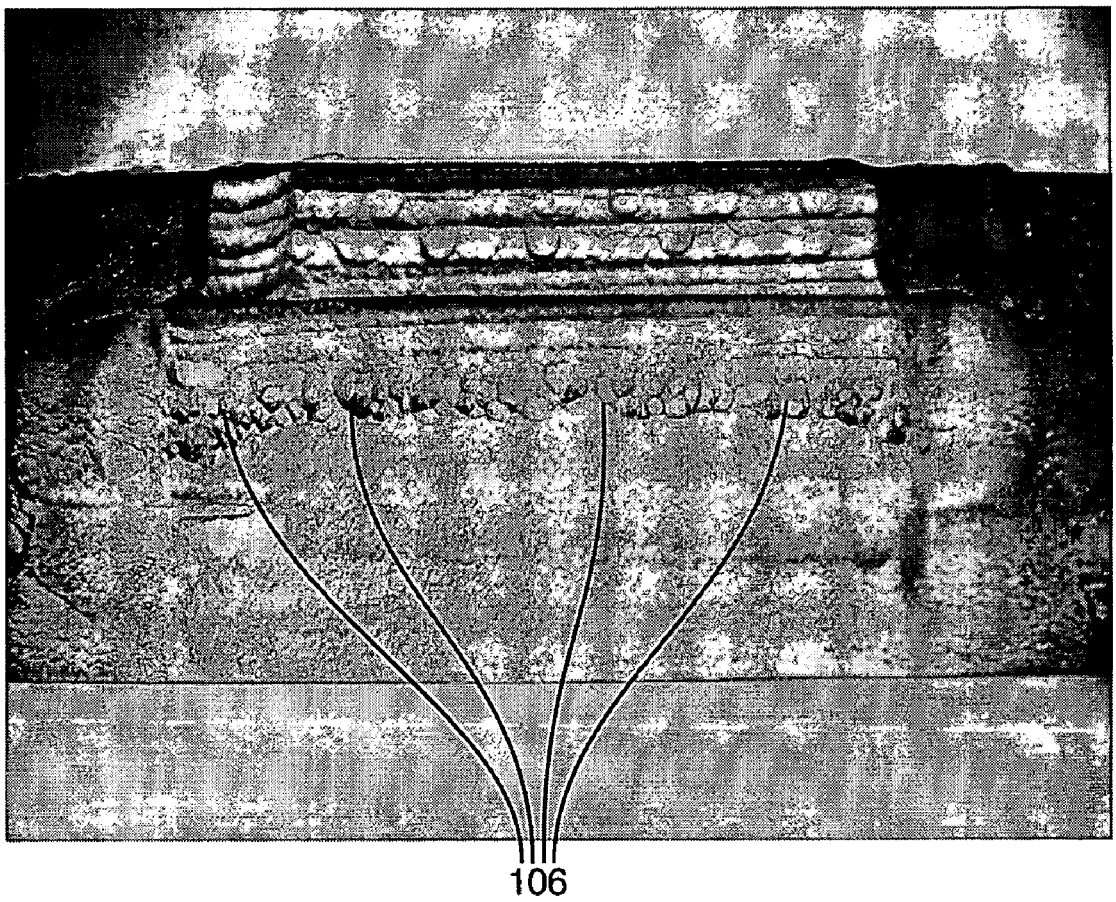
FIG. 4 is a photograph of a kinetically sprayed surface showing a string of isolated conical defects.

In FIG. 4 an example of a string series of defects in a kinetically sprayed copper surface is shown at 106. The multiple defects are separated, but if the kinetic spray were continued they would eventually merge.

Figure 5:
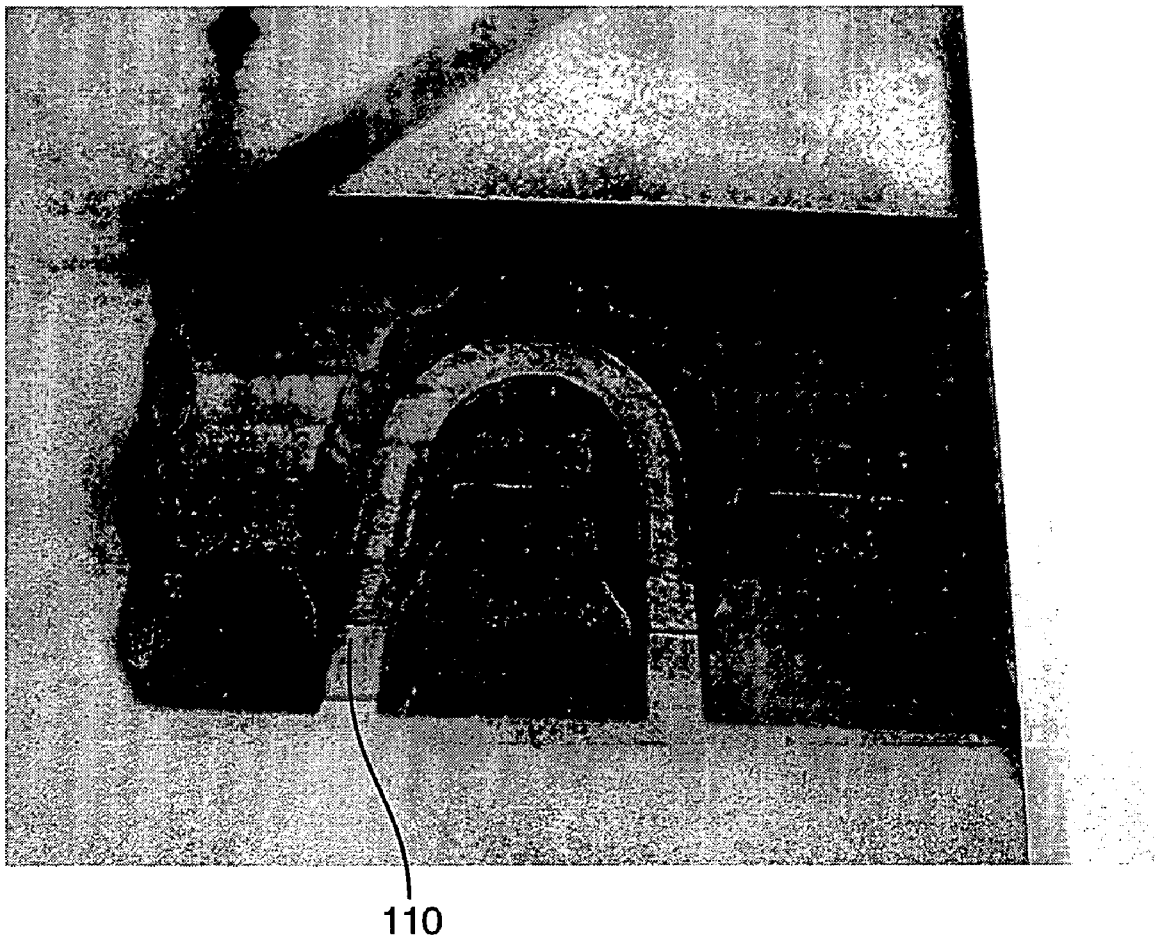
FIG. 5 is a photograph of a kinetically sprayed surface showing a merged string of defects that form a U-shaped channel.

In FIG. 5 an example were a series of defects have merged into a U-shaped channel is shown at 110.

In FIG. 6 the sample from FIG. 4 was taken and a portion 112 was thermally sprayed with monel as described above. One can see that the defects have been fully repaired. It is now possible to continue the kinetic spray application to complete the kinetic spray coating without further defects.

The repair can be made using any thermal spray process. For example, a plasma gas thermal spray process, a High Velocity Oxy-Fuel combustion (HVOF) thermal spray process, a wire arc thermal spray, an air plasma thermal spray, a vacuum plasma, a flame spray, or radio frequency plasma thermal spray. These general processes are known in the art, but have not been utilized to repair kinetically sprayed surfaces. Any of these processes are suitable for applying a thermal sprayed layer to correct the defect.

While the preferred embodiment of the present invention has been described so as to enable one skilled in the art to practice the present invention, it is to be understood that variations and modifications may be employed without departing from the concept and intent of the present invention as defined in the following claims. The preceding description is intended to be exemplary and should not be used to limit the scope of the invention. The scope of the invention should be determined only by reference to the following claims.

The invention claimed is:

1. A method for repairing a defect in a kinetically sprayed surface comprising the steps of:

providing a kinetically sprayed surface having a thickness of at least 5 millimeters formed from particles maintained at a temperature below their melting temperature during kinetic spraying, the kinetically sprayed surface having a defect caused by said kinetic spraying; and applying a repair coating to the defect by thermally spraying a molten material on the defect by a thermal spray process selected from the group consisting of a High Velocity Oxy-Fuel combustion thermal spray process, a wire arc thermal spray process, a vacuum plasma thermal spray process, a flame spray thermal process, or a radio frequency plasma thermal spray process thereby filling the defect and repairing the defect.

2. The method of claim 1, wherein the molten material is formed from the same material as the kinetically sprayed surface.

3. The method of claim 1, wherein the molten material has a different material composition from the kinetically sprayed surface.

4. The method of claim 1, comprising the further step of applying an additional kinetically sprayed coating over the thermally sprayed once molten material.

5. The method of claim 1, wherein the defect comprises at least one conical defect.

6. The method of claim 1, wherein the molten material comprises at least one of a metal or an alloy.

7. The method of claim 6, wherein the molten material comprises a nickel and copper alloy.

8. A method for repairing a defect in a kinetically sprayed surface comprising the steps of:

a) providing a kinetically sprayed surface having a thickness of at least 5 millimeters formed from particles maintained at a temperature below their melting temperature during kinetic spraying, the kinetically sprayed surface having a defect caused by said kinetic spraying;

b) applying a repair coating to the defect by thermally spraying a molten material on the defect by a thermal spray process selected from the group consisting of a High Velocity Oxy-Fuel combustion thermal spray process, a wire arc thermal spray process, a vacuum plasma thermal spray process, a flame spray thermal process, or a radio frequency plasma thermal spray process thereby filling the defect and repairing the defect; and c) applying an additional kinetically sprayed surface over the repaired defect.

9. The method of claim 8, wherein step b) comprises using a molten material formed from the same material as the kinetically sprayed surface.

10. The method of claim 8, wherein step b) comprises using a molten material having a different material composition from the kinetically sprayed surface.

11. The method of claim 8, wherein step a) comprises providing a defect comprising at least one conical defect.

12. The method of claim 8, wherein step b) comprises using a molten material comprising at least one of a metal or an alloy.

13. The method of claim 12, wherein the molten material comprises a nickel and copper alloy.

* * * * *